United States Patent [19]

Bock

[11] 4,170,101

[45] Oct. 9, 1979

[54] METHOD AND APPARATUS FOR PIECING AN ENTWINED YARN

[75] Inventor: Erich Bock, Ingolstadt, Fed. Rep. of Germany

[73] Assignee: Schubert and Salzer, Ingolstadt, Fed. Rep. of Germany

[21] Appl. No.: 960,748

[22] Filed: Nov. 15, 1978

[30] Foreign Application Priority Data

Nov. 11, 1977 [DE] Fed. Rep. of Germany ..... 2753349

[51] Int. Cl.[2] ..... B65H 81/08; D02G 3/36; D01H 15/00

[52] U.S. Cl. ..... 57/6; 57/18; 57/261

[58] Field of Search ..... 57/6, 16–19, 57/261–263, 279, 225

[56] References Cited

U.S. PATENT DOCUMENTS

| | | | |
|---|---|---|---|
| 3,328,946 | 7/1967 | Schumann et al. | 57/18 |
| 3,478,506 | 11/1969 | Kawashima | 57/18 X |
| 3,831,369 | 8/1974 | Northup et al. | 57/225 |
| 3,899,867 | 8/1975 | Northup et al. | 57/18 |
| 3,927,515 | 12/1975 | Northup et al. | 57/18 |
| 4,080,779 | 3/1978 | Freeman et al. | 57/6 |

*Primary Examiner*—John Petrakes
*Attorney, Agent, or Firm*—Bailey, Dority & Flint

[57] ABSTRACT

A method and apparatus for piecing up a broken entwined yarn being produced on a machine from a bundle of spinning fibers and a binding thread. The bundle of spinning fibers are fed through a pair of delivery rollers into a rotating hollow spindle. The binding thread is carried on a bobbin that is, in turn, carried on the hollow spindle for being wrapped around the bundle of fibers as it passes through the hollow spindle producing an entwined yarn. Upon breaking of the entwined yarn the bundle of spinning fibers is deflected between the delivery rollers and the hollow spindle out of its normal path by a stream of suction air. An end of the entwined yarn is drawn off of a takeup bobbin and fed back through the hollow spindle and is united with an end of the binding thread. The ends of the binding thread and the entwined yarn are then twisted together with the bundle of spinning fibers and the production of the yarn is re-initiated.

13 Claims, 3 Drawing Figures

1
2
81
8
S
80
82
85
41
42
43
B
E2
83
L
+ -
40
4
44
31
3
34
S2
32
E1
33
35
G
9
S3
90
6
5
S11
S12
60
61
62
SE
73
E3
E4
72
7
71
70
SP

METHOD AND APPARATUS FOR PIECING AN ENTWINED YARN

BACKGROUND OF THE INVENTION

It is known to produce an entwined yarn from a bundle of spinning fibers emerging from a pair of delivery rollers of a drafting device and a binding thread running off a bobbin which are taken together through a rotating hollow spindle (DT-OS 1,685,881, DT-OS 2,428,483, US-PS 3,831,369, DT-OS 2,407,357). In the course of this operation, the binding thread wraps helically round the bundle of spinning fibers producing a yarn with the strength necessary for its further processing, which is then drawn out of the hollow spindle by a pair of draw-off rollers and wound on a bobbin.

Thus a yarn can be produced in a particularly economical manner with a high production speed, but difficulties arise if piecing has to be effected, for example after a thread breakage. The operator is then faced with the task of connecting together three components, namely the bundle of spinning fiber, the binding thread and the free end of the already finished entwined yarn.

It has already been proposed, for piecing an entwined yarn, to use a compressed-air pistol with a suction tube, by means of which a reduced pressure is produced in the tube or the hollow spindle lying in the center of the binding-thread bobbin so that the bundle of spinning fibers or sliver and the binding thread withdrawn from the rotating bobbin are sucked through the hollow spindle DT-OS 2,428,483). In the course of this, the sliver is strengthened to such an extent that the yarn emerging from the hollow spindle can be taken through the pair of draw-off rollers and laid on the bobbin. A disadvantage of this piecing method is that only two components are united to one another and no connection is effected between the end of the already finished entwined yarn and the end of the yarn emerging from the hollow spindle so that there is a yarn breakage on further processing. Furthermore, the case may arise that the speed of the suction air in the pistol is so high that the bundle of spinning fibers is not bound by the rotating binding thread or that the reduced pressure is too low so that the binding thread is not pulled off the bobbin.

SUMMARY OF THE INVENTION

According to the invention, in the event of a thread breakage, the bundle of spinning fibers continuing to emerge from the pair of delivery rollers is deflected out of its direction of travel by a stream of suction air and that, after stopping of the hollow spindle and the bobbin with the entwined yarn, the end of the entwined yarn is delivered back, through the hollow spindle, to a point between the hollow spindle and the delivery rollers and is there united with the end of the binding thread, after which the two thread ends are twisted with the bundle of spinning fibers by the rotating hollow spindle and the production of the entwined yarn is continued.

The bundle of spinning fibers may appropriately be deflected out of its direction of travel to the hollow spindle by a first stream of suction air and the binding thread and the entwined yarn be united in a second stream of suction air, after which the bundle of spinning fibers is transferred into the second stream of suction air and is twisted with the binding thread and the entwined yarn by the rotating hollow spindle. As a result, the effect is achieved that the spinning fibers brought into the stream of suction air do not form any tufts on the free ends of the binding thread and of the entwined yarn.

A reduction in the suction power is achieved by the fact that the binding thread and the entwined yarn are united in the stream of suction air deflecting the bundle of spinning fiber and are twisted with the bundle of spinning fiber by the rotating hollow spindle.

The invention also relates to an apparatus for carrying out the method which is characterized by a belt lifting device and a lifting device for the bobbin receiving the entwined yarn, which can be actuated through switching devices, and at least one suction tube which is disposed between the pair of delivery rollers and the hollow spindle and the suction opening of which lies in the vicinity of a plane defined by the longitudinal axis of the hollow spindle.

Accordingly, it is an object of the present invention to provide a method and apparatus for piecing up entwined yarn after breakage in a simple and reliable manner.

Another important object of the present invention is to provide a method and apparatus for piecing up entwined yarn by joining all three components (bundle of spinning fibers, binding thread, and end of previously produced entwined yarn) to one another, without interrupting the delivery of the bundle of spinning fibers from a pair of delivery rollers after a yarn breakage has occurred.

These and other objects and advantages of the invention will become apparent upon reference to the following specification, attendant claims and drawings.

DESCRIPTION OF A PREFERRED EMBODIMENT

Figure 1:
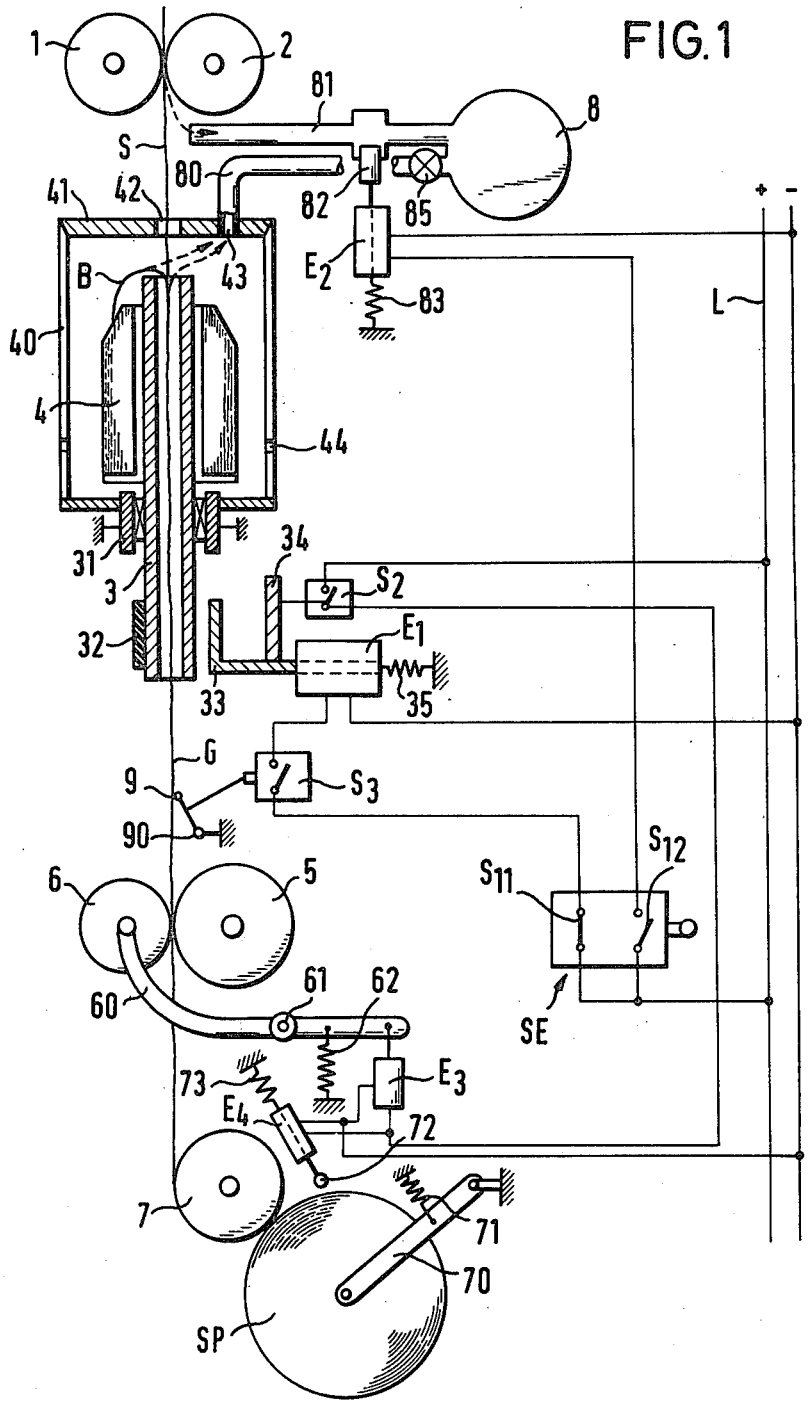
FIG. 1 is an elevational view partially in section and partially shown diagramatically illustrating an apparatus for piecing up entwined yarn after breakage.

According to FIG. 1, a drafting device, of which only a pair of delivery rollers 1, 2 is shown, is followed by a hollow spindle 3. The hollow spindle 3 is rotatably mounted in a frame 31 and is driven continuously, for example by a tangential belt 32. On the hollow spindle 3 there is a bobbin 4 which contains the binding thread B. This can be a filament, a yarn or a twisted yarn. In the example, the bobbin 4 is rigidly connected to the hollow spindle 3 so that it likewise rotates. The tube of the bobbin 4 may, however, also be rotatably mounted on the hollow spindle 3 and be prevented from rotating during current operation.

The hollow spindle 3 is followed, with spacing provided therebetween by a pair of draw-off rollers 5, 6 wherein roller 5 is driven and roller 6 is a pressure roller. The pressure roll 6 is rotatably mounted on an arm 60 which is pivotable about a pin 61 and is pressed against the roller 5 by a tension spring 62 acting on the arm 60. Following the pair of draw-off rollers 5, 6 is a winding device with a drive drum 7, constructed, for example, in the form of a grooved drum, from which the bobbin SP held in a bobbin holder 70 and pressed against the drive 7 by a spring 71 is driven by friction.

The production of the entwined yarn is effected in such a manner that the bundle of spinning fibers S emerging from the pair of delivery rollers 1, 2 and the binding thread B travel through the rotating hollow spindle 3, during which the binding thread B is laid helically round the bundle of spinning fibers S. The bundle of spinning fibers S emerging from the pair of delivery rollers may remain untwisted or be given a false twist for example by being brought into frictional contact with the hollow spindle. Th entwined yarn G produced is drawn out of the hollow spindle 3 by the pair of draw-off rollers 5, 6 and wound to form the bobbin SP by means of the drive drum 7 provided with grooves.

As can be seen from FIG. 1, the hollow spindle 3 and the bobbin 4 containing the binding thread B are surrounded by a stationary housing 40 which encloses them on all sides. The housing 40 can be opened, if necessary, for example by removing a cover 41. The housing 40 has air inlets 44 through which the outside air can be sucked into the interior of the housing 40 as will be explained below. The cover 41 has a passage 42, disposed concentrically with the longitudinal axis of the hollow spindle 3 for the bundle of spinning fibers S coming from the pair of delivery rollers 1, 2 and an eccentric bore 43 into which a suction tube 80 leads which is connected to a suction device 8. The suction tube 80 may appropriately have a resilient intermediate member so that it can be removed from the bore 43 or be moved with the cover 41 when this is removed. A resilient suction line may also be provided instead of a tube. A second suction tube 81 is likewise connected to the suction device 8 and reaches close to the travel path of the bundle of spinning fibers between the pair of delivery rollers 1, 2 and the housing 40 surrounding the bobbin 4.

Associated with the suction tube 81 is a closing member, for example a slide 82 which is brought into a closing position by an electromagnet $E_2$ against the force of a spring 83. The electromagnet $E_2$ can be connected to a line L carrying current, through a switch $S_{12}$ of a switching device SE. The suction tube 80 is preferably also equipped with a closing member 85, which holds the suction tube 80 closed during the entwining operation. The closing member 85 is manually actuated but may, of course, also be provided with an automatic movement similar to that of the slide 82 of the suction tube 80.

Associated with the tangential belt 32 which drives the hollow spindle 3 is a belt lifting device 33 to which a brake shoe 34 is secured. The movement of the belt lifting device 33 with the brake shoe 34 in the direction of the tangential belt 32 is effected by an electromagnet $E_1$ and the return movement is effected by a spring 35. As a result of an appropriate connection, the belt lifting device 33 with the brake shoe 34 is in a position to open and close the contact of a switch $S_2$. The supply of current from the line L to the electromagnet $E_1$ is effected through a switch $S_{11}$ of the switching device SE and a switch $S_3$. The switch $S_3$ is actuated by a thread monitor 9 which is disposed between the hollow spindle 3 and the pair of draw-off rollers 5, 6 and which is pivotable about a pin 90 and presses against the entwined yarn G with its free end.

Connected to the free end of the arm 60 carrying the draw-off roller 6 is an electromagnet $E_3$ while a further electromagnet $E_4$ is intended to urge a ram 72, serving as a lifting device for the bobbin SP, against the bobbin SP, against the force of a spring 73, so that the bobbin is lifted from the drive drum 7, overcoming the force of the spring 71. The electromagnets $E_2$ and $E_3$ can be connected to the line L carrying current, through the switch $S_2$.

FIG. 1 shows the apparatus during the spinning or entwining process. The switch S11 is closed while the switches $S_{12}$, $S_2$, and $S_3$ are open so that all the electromagnets $E_1$, $E_2$, $E_3$ and $E_4$ are de-energized and the corresponding springs are in actiion. The spring 83 holds the slide 82 of the suction line 81 in the open position, as a result of which air is drawn in from the free atmosphere and flows through the suction line 81. The belt lifting device 33 with the brake shoe 34 is held in the retracted position by the spring 35 and the ram 72 associated with the bobbin SP is held in the retracted position by the spring 73. The pressure roller 6 is pressed against the driven draw-off roller 5 by the spring 62 so that the withdrawal of the entwined yarn G from the hollow spindle 3 is effected by these two rollers.

If a thread breakage occurs, usually in the region between the pair of delivery rollers 1, 2 and the entry into the hollow spindle 3, then the bundle of spinning fibers S which continues to emerge freely from the pair of delivery rollers 1, 2 is caught by the stream of suction air flowing in the suction tube 81, which is called the first stream of suction air, and is deflected out of its direction of travel towards the hollow spindle 3, by being drawn into the suction tube 81. At the same time, the thread monitor pivots about the pin 90 as a result of the decreasing thread tension and as a result closes the contact of the switch $S_3$. There is a reduction in the thread tension by such an amount that the thread monitor 9 pivots about the pin 90, for example even if only the bundle of spinning fibers S is torn but not the binding thread B. As a result of the closing of the contact of the switch $S_3$, a current-conducting connection is established between the line L and the electromagnet $E_1$. The electromagnet $E_1$ presses the belt lifting device 33 against the tangential belt 32 which is lifted from the hollow spindle 3 and the brake shoe 34 bears against the side of the hollow spindle 3 and stops this. As a result of the movement of the belt lifting device 33 with the brake shoe 34 towards the hollow spindle 3, the contact of the switch $S_2$ is also closed, through which current now flows to the electromagnets $E_3$ and $E_4$. The electromagnet $E_3$ acts against the force of the spring 62 so that the arm 6o pivots about the pin 61 and the pressure roller 5 is lifted from the driven draw-off roller 6. At the same time, the electromagnet $E_4$ presses the ram 72 against the bobbin SP and lifts it from the drive drum, overcoming the force of the spring 71. Thus, the draw-off and winding operation is interrupted. If the binding thread B is not also torn, it is cut off between the hollow spindle and the pair of draw-off rollers.

The piecing is effected in such a manner that first the end of the entwined yarn G, which is on the bobbin SP or a store (not shown), for example, preceding the bobbin SP, is delivered back from there to a point between the pair of delivery rollers 1, 2 and the hollow spindle 3, which, in the present case, is defined by the entrance of the suction tube 80. For this purpose, a length of the entwined yarn G corresponding substantially to the distance between the bobbin SP or a yarn storage position preceding this and the suction tube 80 is removed from this so that only a limited length of the entwined yarn G subsequently reaches the suction tube 80. The end of the entwined yarn G is introduced into the hollow spindle 3 passing through between the pressure roller 5 and the driven draw-off roller 6. The closing member 85 of the suction tube 80 is opened, as a result of which outside air is drawn through the opening 42, the air inlets 44 of the housing 40 and the hollow spindle 3 and a reduced pressure develops in the interior of the housing 40. This stream of suction air, which is called the second stream of suction air, now pulls the entwined yarn G through the hollow spindle 3 in the direction of the delivery rollers 1, 2 and into the suction tube 80.

The seeking and exposure of the binding thread B on the bobbin 4 is effected automatically by an eddy of air in the interior of the housing 40 which is produced by the air which flows through the air inlets 44. If necessary, this eddy of air can be intensified by compressed-air twist nozzles. A certain length of the binding thread B is then likewise sucked into the suction tube 80. If the binding thread B is not torn and is still in the hollow spindle 3, then it enters the suction tube 80 simultaneously with the entwined thread G.

Thus the two components entwined yarn G and binding thread B are brought together in a certain length in the second stream of suction air of the suction tube 80 and are held under tension by the reduced pressure in the suction tube 80, while the bundle of spinning fibers S, deflected out of its direction of travel to the hollow spindle 3 by the first stream of suction air is continuously drawn off through the suction tube 81. After this first piecing stage, the second and last is now initiated in that the switch $S_{12}$ of the switching device SE is closed and the switch $S_{11}$ is opened. As a result, a connection is established between the current-conducting line L and the electromagnet $E_2$, as a result of which the electromagnet $E_2$ moves the slide 82 into the closed position against the force of the spring 83 and interrupts the stream of suction air in the suction tube 81. At the same time, the electromagnet E, is de-energized by the opening of the switch $S_{11}$ so that the spring 35 comes into action and moves the belt lifting device 33 with the brake shoe 34 away from the tangential belt 32 and the hollow spindle 3. The hollow spindle 3 starts to run, driven by the tangential belt 32.

As a result of the movement of the belt lifting device 33 with the brake shoe 34 disposed thereon away from the hollow spindle 3, the switch $S_2$ is opened. Thus, simultaneously with the starting of the hollow spindle 3, or after its starting if appropriately built-in delay members (not shown) are provided, the electromagnets $E_3$ and $E_4$ are de-energized and the spring 73 associated with the ram 72 as well as the spring 62 acting on the arm 60 of the pressure roller 6 become effective. They press the pressure roller 6 against the driven roller 5 and the bobbin SP receiving the entwined yarn G against the drive drum 7.

The bringing into service of the hollow spindle 3 and of the parts of the apparatus following it in the manner described, on the one hand causes the entwined yarn G and the binding thread B present in the suction tube 80 to be pulled out of this and form a thread balloon. On the other hand, as a result of the first stream of suction air being interrupted in the suction tube 81, the bundle of spinning fiber S is released by this and is caught by the second stream of suction air flowing through the opening 42 into the interior of the housing and is pulled into this. In the course of this, the bundle of spinning fibers S which is now in the second stream of suction air is caught by the thread balloon formed by the binding thread B and the entwined yarn G and is twisted with these two components. Meanwhile, the thread monitor 9 is pivoted about its pin 90 by the tension of the running thread and has opened the switch $S_3$. After termination of the piecing operation in the manner described, the switch $S_{12}$ is opened and the switch $S_{11}$ is closed by the operator. As a result of the opening of the switch $S_{12}$, the electromagnet $E_2$ is de-energized and the slide 82 belonging to the suction tube 81 is opened so that suction air again flows through the suction tube 81 and is available to deflect the bundle of spinning fibers S out of its direction of travel to the hollow spindle 3 in the event of a later thread breakage. Furthermore, the closing member 85 of the suction tube 80 is closed.

Figure 2:
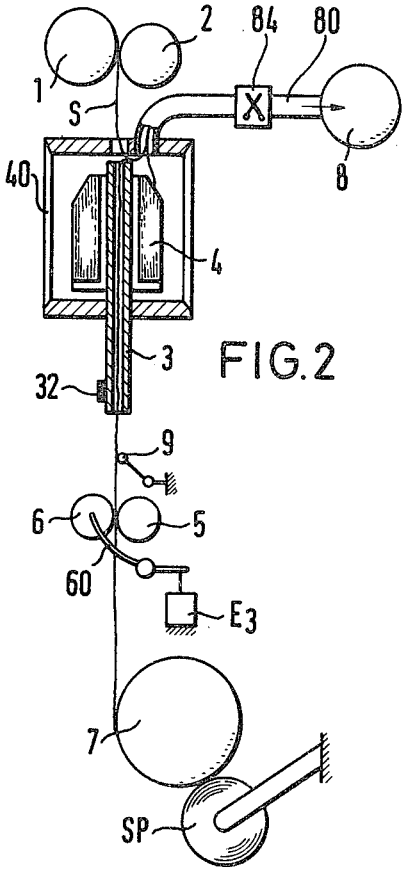
FIG. 2 is a diagramatic view illustrating a modified form of the apparatus of FIG. 1.

FIG. 2 shows a possibility of carrying out the piecing of the three components, bundle of spinning fiber S, binding thread B and entwined yarn G with only the suction tube 80. Since all the other parts of the apparatus correspond to those in FIG. 1, a repetition of the details can be dispensed with and the description can be restricted to the modification of the piecing process as it was described with reference to FIG. 1. This modification consists in that, in the event of a thread breakage, the bundle of spinning fibers S continuing to emerge from the pair of delivery rollers 1, 2 is deflected out of its direction of travel by the stream of suction air flowing in the suction tube 80, is that it is conveyed through the opening 42 in the housing 30 into the suction tube 80. The entwined yarn G and the binding thread B are then brought together in this stream of suction air of the suction tube 80, deflecting the bundle of spinning fibers S, as described with reference to FIG. 1, so that all three components— bundle of spinning fibers S, entwined yarn G and binding thread B—are combined in a single stream of suction air. In this case, it is necessary for the inlet end of the hollow spindle 3 to be at such a great distance from the cover 41 that the bundle of spinning fibers S is not caught by this end of the hollow spindle 3 and slung away or wound round the hollow spindle. As a result of taking the hollow spindle 3 into service with the parts of the apparatus following it, in the manner already described, the three components to be united are twisted together in the stream of suction air of the suction tube 80. Since a relatively large tuft can form with this manner of combining in the suction tube 80, the thread structure is cut off at a given time in the suction tube 81. This is effected by a cutting device 84 which is actuated by the electromagnet, like the slide 82 with the associated electromagnet, in FIG. 1. Otherwise the piecing operation is the same as described with reference to FIG. 1.

Figure 3:
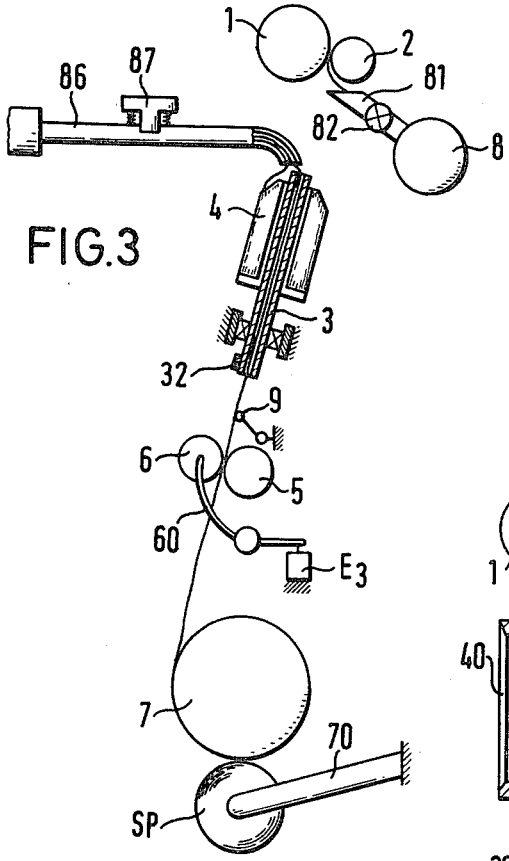
FIG. 3 is a side elevational view partially illustrated diagramatically illustrating a stationary and movable suction tube for use in a yarn piecing apparatus.

The delivery of the entwined yarn G back to a point between the delivery rollers 1, 2 and the inlet end of the hollow spindle 3, its combining with the binding thread B at this point and the twisting of these two components with the bundle of spinning fibers S by bringing the hollow spindle 3 into service can also be carried out with an entwining device of which the hollow spindle 3 and binding-thread bobbin 4 are not surrounded by the housing 40 shown in FIGS. 1 and 2 (FIG. 3). Instead of the suction tube 80 leading eccentrically to the hollow spindle 3 into the housing 40, in this case a suction tube 86, which is movable between the inlet end of the hollow spindle 3 and the delivery rollers 1, 2 is used to produce a second stream of suction air and is connected or can be connected to the suction device 8 and is handled by the operator. The suction tube 86 preferably has a throttle valve 87.

After a thread breakage recorded by the thread monitor 9, the bundle of spinning fibers emerging freely from the pair of delivery rollers 1, 2 in the manner already described is deflected out of its direction of travel by the first stream of suction air of the suction tube 81, the hollow spindle 3 is stopped and the pressure roller 6 is lifted from the driven draw-off roller 5 and the bobbin SP from the drive drum 7. Then the end of the entwined yarn G unwound from the bobbin SP is introduced into the hollow spindle, and is pulled, possibly with the binding thread B still in the hollow spindle 3, through this, in the direction of the delivery rollers 1, 2 and into the suction tube 86, by the mouth of the suction tube 86 being brought close to the inlet of the hollow spindle 3 with the throttle valve 87 open. If the binding thread B is broken, then its end is sought manually on the bobbin 4 and likewise introduced into the suction tube 86. The lengths of thread to be unwound from the bobbin SP and the bobbin 4 are each dimensioned so that there is a certain length of the entwined yarn G and of the binding thread B in the suction tube 86. Thus the binding thread B and the entwined yarn G are combined in the stream of suction air of the suction tube 86 and are held under tension by this.

The suction tube 86 is then brought into such a position between the inlet of the hollow spindle 3 and the pair of delivery rollers 1, 2 that, when the slide 82 of the suction tube 81 is now closed, the spinning fiber material jumps out of the first stream of suction air of the suction tube 81 into the second stream of suction air of the suction tube 86. The closing of the slide 82 is preferably effected shortly before or simultaneously with the taking into service of the hollow spindle 2 and of the parts of the apparatus following it. The three components—binding yarn B, entwined yarn G and bundle of spinning fiber S—now combined in the suction air stream of the suction tube 86 are twisted together by the rotation of the ends of the binding yarn B and entwined yarn G emerging from the suction tube 86, drawn off by the pair of draw-off rollers 5, 6 and wound on the bobbin SP. The throttle valve 87 is actuated to facilitate the twisting operation, particularly with fine yarns. After termination of the piecing operation, the slide 82 of the suction tube 81 is opened again. The suction tube 86 may be used for the piecing at further spinning stations.

The piecing method according to the invention has been described with reference to an entwining device with a driven hollow spindle. It may also be used, however, on an entwining device with a stationary hollow spindle and a driven binding thread bobbin. Other solutions are also possible with regard to the movement mechanism for the lifting devices in the devices described for carrying out the method. Thus a pneumatic or hydraulic actuation of the lifting devices and possibly also a manual actuation may be provided instead of electromagnets, for example. The switching arrangement can also be modified, for example in that the lifting of the pressure roller of the pair of draw-off rollers and of the bobbin receiving the entwined yarn is initiated not through a switch actuated by the belt lifting device but through a manually actuated switch.

If necessary, the lifting of the pressure roller 6 of the pair of draw-off rollers from the driven roller 5 can be dispensed with if, on the response of the thread monitor 9, a possible further withdrawal of the binding thread B from its bobbin 4 is prevented by a thread-gripping device 63 (FIG. 2) disposed between the hollow spindle 3 and the pair of draw-off rollers 5, 6 and care is taken to ensure that during the following piecing operation, as described above, the entwined yarn G running out of the hollow spindle 3 only comes between the pair of draw-off rollers 5, 6 after the bobbin SP has been placed on the drive drum 7.

While a preferred embodiment of the invention has been described using specific terms, such description is for illustrative purposes only, and it is to be understood that changes and variations may be made without departing from the spirit or scope of the following claims.

What is claimed is:

1. A method of piecing up a broken entwined yarn being produced on a machine from a bundle of spinning fibers and a binding thread, a driven hollow spindle, a pair of delivery rollers feeding said bundle of spinning fibers to said hollow spindle, a bobbin carrying said binding thread, said binding thread running off said bobbin and being wrapped around said bundle of fibers, said bundle of spinning fibers with said binding thread wrapped therearound passing through said hollow spindle and being wound as entwined yarn on a second driven bobbin, said method comprising the following steps:

deflecting said bundle of spinning fibers continuing to emerge from said pair of delivery rollers from its normal path of travel between said delivery rollers and said hollow spindle with a stream of suction air responsive to breakage of said entwined yarn;

stopping the rotation of said hollow spindle and said second driven bobbin;

delivering an end of said entwined yarn from said second bobbin back through said hollow spindle to a point between said hollow spindle and said pair of delivery rollers and uniting with an end of said binding thread extending from said bobbin; starting the rotation of said hollow spindle;

twisting said end of said entwined yarn, said binding thread and said bundle of spinning fibers together with said rotating hollow spindle; and again driving said second bobbin for continuing the production of said entwined yarn.

2. A method as claimed in claim 1 further comprising:

said bundle of spinning fibers being deflected from its direction of travel to said hollow spindle by a first stream of suction air and said binding thread and said entwined yarn are united in a second stream of suction air, after which the bundle of spinning fibers is transferred into said second stream of suction air and is twisted with the binding thread and the entwined yarn by using said rotating hollow spindle.

3. A method as claimed in claim 1 further comprising said binding thread and the entwined yarn are united in said stream of suction air deflecting the bundle of spinning fibers and are twisted with the bundle of spinning fibers by said rotating hollow spindle.

4. An apparatus for piecing up a broken entwined yarn being produced on a machine from a bundle of spinning fibers and a binding thread, a driven hollow spindle, a pair of delivery rollers feeding said bundle of spinning fibers to said hollow spindle, a bobbin carrying said binding thread, said binding thread running off said bobbin and being wrapped around said bundle of spinning fibers, said bundle of spinning fibers with said binding thread wrapped therearound passing through said hollow spindle and being wound as entwined yarn on a second driven bobbin, said apparatus comprising:

suction means for deflecting said bundle of spinning fibers continuing to emerge from said pair of delivery rollers after breakage of said entwined yarn from its normal path of travel between said delivery rollers and said hollow spindle;

means for stopping the rotation of said hollow spindle and said second driven bobbin;

means for delivering an end of said entwined yarn from said second bobbin back through said hollow spindle to a point between said hollow spindle and said pair of delivery rollers and uniting with an end of said binding thread extending from said bobbin;

means for restarting the rotation of said hollow spindle;

means for twisting said end of said entwined yarn, said binding thread and said bundle of spinning fibers together with said rotating hollow spindle; and means for restarting the driving of said second bobbin for continuing the production of said entwined yarn.

5. The apparatus as set forth in claim 4 further comprising:

a driven roller for driving said second bobbin;

switch means sensing a breakage in said entwined yarn;

a lifting device for moving said driven roller out of engagement with said second bobbin upon being activated; and means for activating said lifting device responsive to said switch means sensing a break in said entwined yarn for stopping said second bobbin.

6. The apparatus as set forth in claim 4 or 5 further comprising:

said suction means including:

(i) at least one suction tube disposed between said pair of delivery rollers and said hollow spindle, and (ii) a suction opening provided in said suction tube which lies in the vicinity of a plane defined by the longitudinal axis of said hollow spindle.

7. The apparatus as set forth in claim 4 further comprising:

a stationary housing surrounding said hollow spindle and said bobbin;

a passage provided in said housing through which said bundle of spinning fibers are fed to said hollow spindle; and a suction tube radially spaced from an axis of said hollow spindle communicating with the interior of said housing.

8. The apparatus as set forth in claim 7 further comprising:

an air inlet provided in said housing.

9. The apparatus as set forth in claim 7 further comprising:

a closing member for selectively closing said first and second suction tubes.

10. The apparatus as set forth in claim 9 further comprising:

an electromagnet operably connected to said closing member; and switch means for selectively energizing said electromagnet for selectively closing said closing member.

11. The apparatus as set forth in claim 4 further comprising:

said suction means for deflecting said bundle of spinning fibers including a first suction tube having a suction opening which lies adjacent a nip point of said pair of delivery rollers; and said means for delivering an end of said entwined yarn from said second bobbin back through said hollow spindle and uniting with an end of said binding thread extending from said bobbin including a second suction tube communicating with the interior of said housing.

12. The apparatus as set forth in claim 4 further comprising:

said suction means for deflecting said bundle of spinning fibers including a stationary suction tube ending adjacent to the nip point of said pair of delivery rollers; and said means for delivering an end of said entwined yarn from said bobbin back to said hollow spindle including a movable suction tube which is movable between an inlet of said hollow spindle and said pair of delivery rollers.

13. The apparatus as set forth in claim 12 further comprising:

said movable suction tube including a throttle valve.

* * * * *